US007203440B2

(12) United States Patent
Sakai et al.

(10) Patent No.: US 7,203,440 B2
(45) Date of Patent: Apr. 10, 2007

(54) IMAGE FORMING APPARATUS WITH A PLURALITY OF SELECTABLE MODES TO MAINTAIN TEMPERATURE

(75) Inventors: Hiroaki Sakai, Shizuoka (JP); Yasunari Kobaru, Shizuoka (JP); Mitsuhiro Ito, Shizuoka (JP); Tomoyuki Makihira, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/822,721

(22) Filed: Apr. 13, 2004

(65) Prior Publication Data

US 2004/0202491 A1 Oct. 14, 2004

(30) Foreign Application Priority Data

Apr. 14, 2003 (JP) ..... 2003-109106

(51) Int. Cl.
*G03G 15/20* (2006.01)

(52) U.S. Cl. ..... 399/70

(58) Field of Classification Search ..... 399/70, 399/67–69

See application file for complete search history.

(56) References Cited

U.S. PATENT DOCUMENTS

| | | | | |
|---|---|---|---|---|
| 5,051,780 | A * | 9/1991 | Stelter et al. | 399/70 |
| 5,449,162 | A | 9/1995 | Saito et al. | 271/122 |
| 5,682,576 | A | 10/1997 | Sakai et al. | 399/69 |
| 5,768,654 | A | 6/1998 | Noguchi et al. | 399/69 |
| 5,819,134 | A | 10/1998 | Sato et al. | 399/69 |
| 5,904,871 | A | 5/1999 | Sakai et al. | 219/216 |
| 6,438,348 | B2 | 8/2002 | Kobaru et al. | 399/333 |
| 6,496,661 | B2 | 12/2002 | Ando et al. | 399/22 |
| 6,516,165 | B2 | 2/2003 | Makihira et al. | 399/69 |
| 6,560,437 | B2 | 5/2003 | Kobaru et al. | 399/315 |
| 6,587,662 | B2 | 7/2003 | Kobaru et al. | 399/323 |
| 6,658,229 | B2 | 12/2003 | Ando et al. | 399/323 |
| 6,882,808 | B2 * | 4/2005 | Ota | 399/69 |
| 2002/0186986 | A1 | 12/2002 | Makihira | 399/92 |
| 2004/0022551 | A1 | 2/2004 | Ito et al. | 399/67 |

FOREIGN PATENT DOCUMENTS

| | | |
|---|---|---|
| JP | 6-278308 | 10/1994 |
| JP | 2000075726 A * | 3/2000 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The image forming apparatus includes an image formation unit for forming a toner image on a recording material to be carried by the recording material; a fixing apparatus having a heat-fixing rotation member and a pressure member with an elastic layer which rotate while pressed against each other, the heat-fixing rotor providing heat for heat-fixing treatment of the toner image formed on the recording material as the recording material is introduced into a press-fit nip portion of the rotors and held and transported between the rotors; and temperature adjusting means for adjusting a temperature of the pressure rotor by heating the pressure rotor at least during non-printing time. Thus, the image forming apparatus can achieve, even when the pressure rotor is heated, the best balance between the fixing performance and service life of the pressure rotor under actual use conditions.

20 Claims, 4 Drawing Sheets

IMAGE FORMING APPARATUS WITH A PLURALITY OF SELECTABLE MODES TO MAINTAIN TEMPERATURE

BACKGROUND OF THE INVENTION

1. Field of the Invention

The present invention relates to an image forming apparatus such as a copying machine or a laser beam printer.

2. Related Background Art

In general, an image forming apparatus such as a copier or a printer has image formation means and fixing means. The image formation means is for directly forming or transferring an unfixed toner image corresponding to image information on a recording material by a suitable image forming principle or process such as an electrophotography process or an electrostatic recording process. The fixing means fixes the toner image formed and bore on the recording material.

In general, a heat-fixing device is used as fixing means, which fixes an unfixed toner image on a recording material by heating the image. Thermal roller type fixing devices are employed most often.

A thermal roller type fixing device is equipped with a fixing roller, which serves as a heat-fixing rotor, and an elastic pressure roller, which has an elastic layer and which serves as a pressure rotor. The fixing roller and the elastic pressure roller rotate while pressed against each other. A recording material carrying an unfixed toner image is introduced into a press-fit nip portion between the fixing roller and the pressure roller, so that the image is fixed by heat from the fixing roller as the recording material is held and transported between the two rollers.

The fixing roller is heated by a heater serving as heating means, and a temperature of the fixing roller is adjusted to reach a given fixing temperature (temperature during printing) by temperature adjusting means. While an image forming apparatus is on standby, the temperature adjusting means controls the fixing roller temperature to a given standby temperature, which is set lower than the given fixing temperature, enabling the image forming apparatus to start printing immediately after receiving a command to print. Some known image forming apparatuses are capable of changing the fixing temperature (temperature during printing) and standby temperature of their fixing rollers in accordance with an environmental temperature (see Japanese Patent Application Laid-open No. 06-278308, for example).

If the elastic pressure roller of the above-described fixing device is also heated by the heater serving as heating means and is adjusted to have a given temperature, a toner image can be fixed well on rough-surface paper or thick paper, which would otherwise be difficult to print on.

However, a pressure roller that has a thick elastic layer loses the elasticity of the elastic layer at an accelerated rate through heating. Therefore, heating the pressure roller with a priority on improved fixing performance cuts short the service life of the pressure roller whereas giving priority to extended service life of the pressure roller lowers the performance of fixing an image on rough-surface paper and thick paper.

In addition, the pressure roller is pressurized at a given pressurizing force as well as the fixing roller and, if the pressure roller is heated while a certain load is applied, the elasticity of the elastic layer is degraded at an accelerated rate in a portion where the load is applied.

SUMMARY OF THE INVENTION

The present invention has been made in view of the above-described conflicting the above-described problem concerning the pressure roller. An object of the present invention is therefore to provide an image forming apparatus with a fixing device in which a heat-fixing rotor and a pressure rotor having an elastic layer rotate while pressed against each other to heat-fix a toner image carried on a recording material by heat from the heat-fixing rotor as the recording material is introduced into a press-fit nip portion of the two rotors to be held and transported between the two rotors and which can achieve, even when the pressure rotor is heated, the best balance between the fixing performance and service life of the pressure rotor under actual use conditions while setting the fixing performance and life service of the pressure rotor optimally for practical use.

An image forming apparatus according to the present invention includes an image forming unit for forming a toner image on a recording material to be carried by the recording material, a fixing apparatus having a heat-fixing rotor and a pressure rotor with an elastic layer which rotate while pressed against each other, the heat-fixing rotor providing heat for heat-fixing treatment of the toner image formed on the recording material as the recording material is introduced into a press-fit nip portion of the rotors and held and transported between the rotors; and temperature adjusting means for adjusting a temperature of the pressure rotor by heating the pressure rotor, in which a condition of a temperature adjustment made by the temperature adjusting means can be changed at least during non-printing time.

Preferably, the temperature adjusting means has plural temperature control modes that can be chosen as a temperature control mode executed by the temperature adjusting means in at least non-printing time, and the temperature adjusting means operates in a temperature control mode selected.

Preferably, the temperature adjusting means includes a switching device that opens or cuts a current flow from a commercial power source to heating means, temperature detecting means for detecting the temperature of the pressure rotor, and control means for controlling the switching device in accordance with detection information provided by the temperature detecting means.

Preferably, the image forming apparatus further includes second temperature adjusting means, which heats the heat-fixing rotor to adjust a temperature of the heat-fixing rotor.

Preferably, the second temperature adjusting means includes heating means for heating the heat-fixing rotor, adjustment means for opening or cutting a current flow from a commercial power source to the heating means, temperature detecting means for detecting the temperature of the heat-fixing rotor, and control means for controlling the adjustment means in accordance with detection information provided by the temperature detecting means.

Preferably, the temperature control mode during a standby temperature adjustment can be selected arbitrarily.

Preferably, the temperature control mode during a power-saving temperature adjustment can be selected arbitrarily.

Preferably, the temperature control mode for when the image forming apparatus is in a sleep mode can be selected arbitrarily.

Preferably, whether the heating means is electrified or not during non-printing time can be chosen by the temperature adjusting means.

Preferably, an adjustment temperature in non-printing time can be selected arbitrarily by the, temperature adjusting means.

Preferably, intervals at which the heating means is electrified during non-printing time can be selected arbitrarily by the temperature adjusting means.

Preferably, a unit electrification time of the heating means during non-printing time can be selected arbitrarily by the temperature adjusting means.

Preferably, the temperature control modes include a control mode in which the pressure rotor of the fixing apparatus is driven intermittently during non-printing time, and intervals at which the pressure rotor is driven can be selected arbitrarily.

Preferably, the temperature control modes include a control mode in which the pressure rotor of the fixing apparatus is driven intermittently during non-printing time, and the intermittent drive period can be chosen arbitrarily.

Preferably, the image forming apparatus further includes pressuring force switching means for switching a pressuring force at which the pressure rotor of the fixing apparatus is pressed against the heat-fixing rotor, in which the pressuring force of when the image forming apparatus is not printing can be chosen arbitrarily.

Preferably, the temperature adjustment conditions, the temperature control modes, the pressure rotor drive control mode, or the pressuring force is switched by an interface command from a printer controller.

Preferably, the temperature adjustment conditions, the temperature control modes, the pressure rotor drive control mode, or the pressurizing force is switched by referring to identification means of a printer controller.

Preferably, the temperature adjustment conditions, the temperature control modes, the pressure rotor drive control mode, or the pressurizing force is switched by an operation panel.

Preferably, the temperature adjustment conditions, the temperature control modes, the pressure rotor drive control mode, or the pressuring force is switched by changing a setting of printer driver software.

Preferably, the temperature adjustment conditions, the temperature control modes, the pressure rotor drive control mode, or the pressuring force is switched by switching means on an electric circuit.

According to the present invention, the service life of the pressure rotor can be prolonged by controlling the standby temperature of the pressure rotor in a manner that gives priority to the fixing performance when no printing is performed in the case where rough-surface paper and thick paper take up a major portion of the paper to be printed on and by setting the standby temperature of the pressure rotor low or not electrifying the pressure rotor at all in the case where plain paper takes up a major portion of the paper to be printed on.

The present invention thus can provide an image forming apparatus that allows a user to choose a fixing performance and service life of a pressure rotor of a fixing device that are optimal under the actual use conditions.

DESCRIPTION OF THE PREFERRED EMBODIMENTS (Embodiment 1)

(1) Image Forming Apparatus Example

Figure 1:
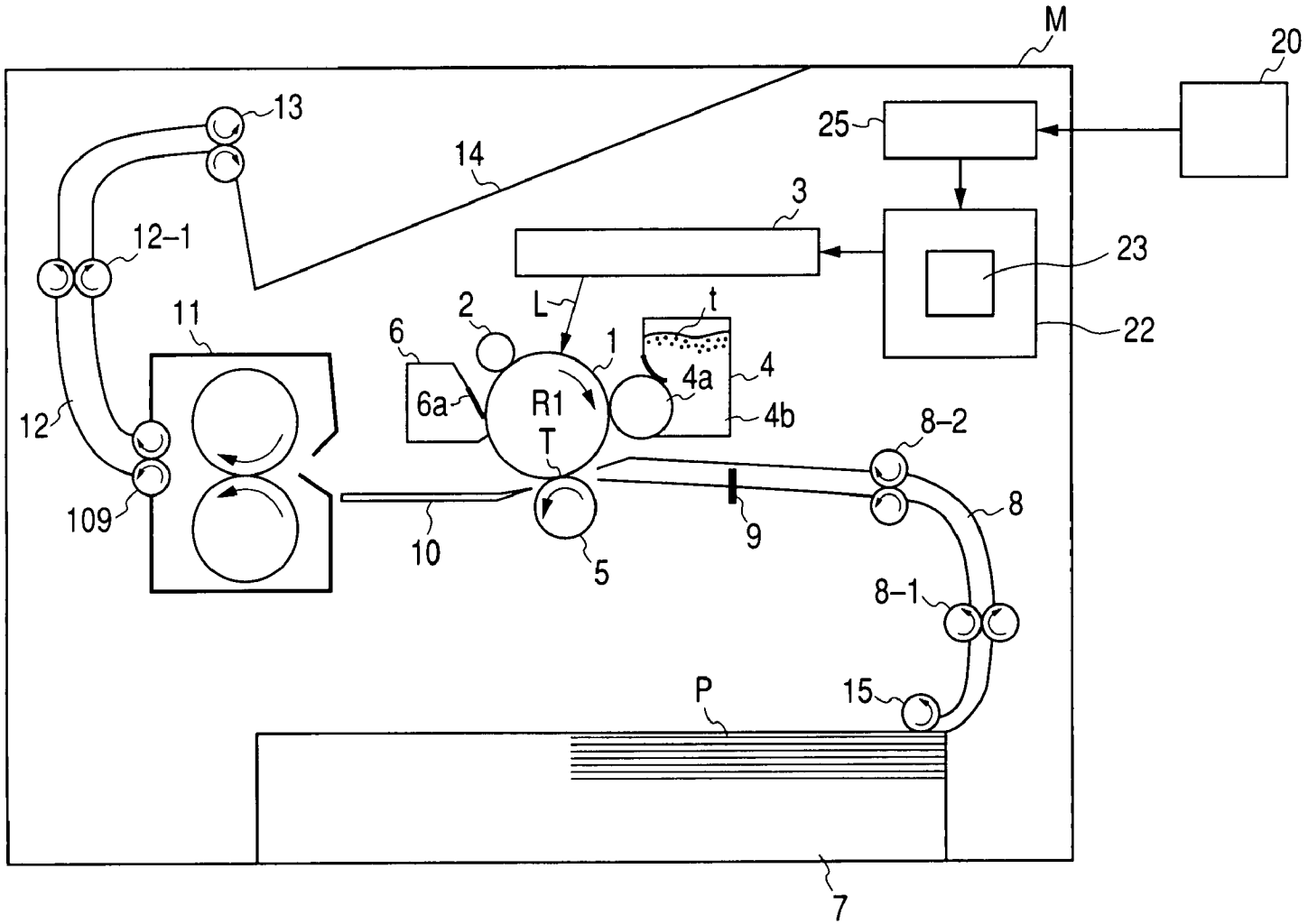
FIG. 1 is a schematic structural model diagram of an image forming apparatus according to Embodiment 1.

FIG. 1 is a schematic structural model diagram of an example of an image forming apparatus according to the present invention. The image forming apparatus of this example is a laser printer of transfer type and an application of an electrophotographic method.

The image forming apparatus includes an electrophotographic photosensitive drum 1, which is driven and rotated, in the clockwise direction of an arrow R1, at a given peripheral velocity as a print start signal is inputted to a control unit. The image forming apparatus includes an electrostatic charging device 2 provided for uniform charging of a circumferential face of the rotating photosensitive drum 1 to give the circumferential face a given polarity and electric potential. A laser scanner 3 as an exposure device. The laser scanner 3 outputs laser light L which undergoes On-OFF modulation in accordance with image information in the form of time series electric digital pixel signals inputted from an external host apparatus 20 such as an image reading device, a computer, or a fax machine to a printer M. The charged face of the rotating photosensitive drum 1 is scanned and exposed with the laser light L. This removes electric charges from a portion of the photosensitive drum face that is exposed to the laser light, thereby forming an electrostatic latent image that corresponds to an image information pattern of the scan and exposure.

The image forming apparatus has a developing apparatus 4 composed of a developing container 4*b*, a developing sleeve 4*a*, and others. The developing container 4*b* contains developer (hereinafter referred to as toner) t. The developing sleeve 4*a* receives application of given developing bias from a power source (not shown) to selectively supply the face of the photosensitive drum 1 with toner t in accordance with the electrostatic latent image pattern. In this way, the electrostatic latent image on the photosensitive drum surface is developed or reversely developed as a toner image.

A sheet feeding cassette 7 in which a paper or other recording material (transfer material) P is stored is placed in a lower part of the interior of a printer main body. One sheet of the recording material P in the sheet feeding cassette 7 is separated from the rest of the stack and fed by a sheet feeding roller 15, which is driven at given control timing. The fed recording material P is transported along a recording material transport path 8 by transport rollers 8-1 and 8-2 to be introduced into a transfer nip portion T where the photosensitive drum 1 is in contact with a transfer roller 5 serving as a transfer member. Given transfer bias having a polarity opposite to the toner charge polarity is applied to the transfer roller 5 by a power source (not shown) for electrostatic transfer of the toner image on the photosensitive drum face onto a surface of the recording material P held and transported between the transfer nip portion T.

A top sensor 9 is placed at a point between the transport roller 8-2 and the transfer nip portion T along the recording material transport path 8 to detect arrival of the front end of a recording material sheet and passage of the rear end of the sheet. An engine controller 22, which is a printer controlling part, controls timing of starting laser scan and exposure of the photosensitive drum face, detects a jammed recording material sheet, and performs other tasks based on a detection signal the top sensor 9 sends out.

After passing the transfer nip portion T, the recording material P is separate from the photosensitive drum face and introduced into a fixing apparatus 11 by a transport guide 10. The fixing apparatus 11 heats and pressurizes the unfixed toner image on the recording material to permanently fix the image on the recording material. Details of the fixing apparatus 11 will be given in the following Section (2).

The photosensitive drum face has a residue such as toner and paper dust left after the transfer and peeling of the recording material. The residue is removed by a cleaning blade 6*a* of a cleaning device 6 to prepare the photosensitive drum 1 for another round of image forming.

The heat-fixing treatment of the unfixed toner image by the fixing apparatus 11 is followed by discharge of the recording material P from a fixed sheet delivery roller 109. The recording material P then enters a recording material transport path 12 to be transported by a transport roller 12-1 and a sheet delivery roller 13 and is delivered as a printed material onto a delivery tray 14.

The engine controller 22 is for control in general of an engine including a microprocessor unit (MPU) 23 to form an image in accordance with dot information sent from a printer controller 25. In other words, the engine controller 22 conducts the overall sequence control of an image information operation of the printer. The printer controller 25 extracts dot information from image data sent from the external host apparatus 20 such as a computer and transmits the dot information to the engine controller 22.

(2) Fixing Apparatus 11

Figure 2:
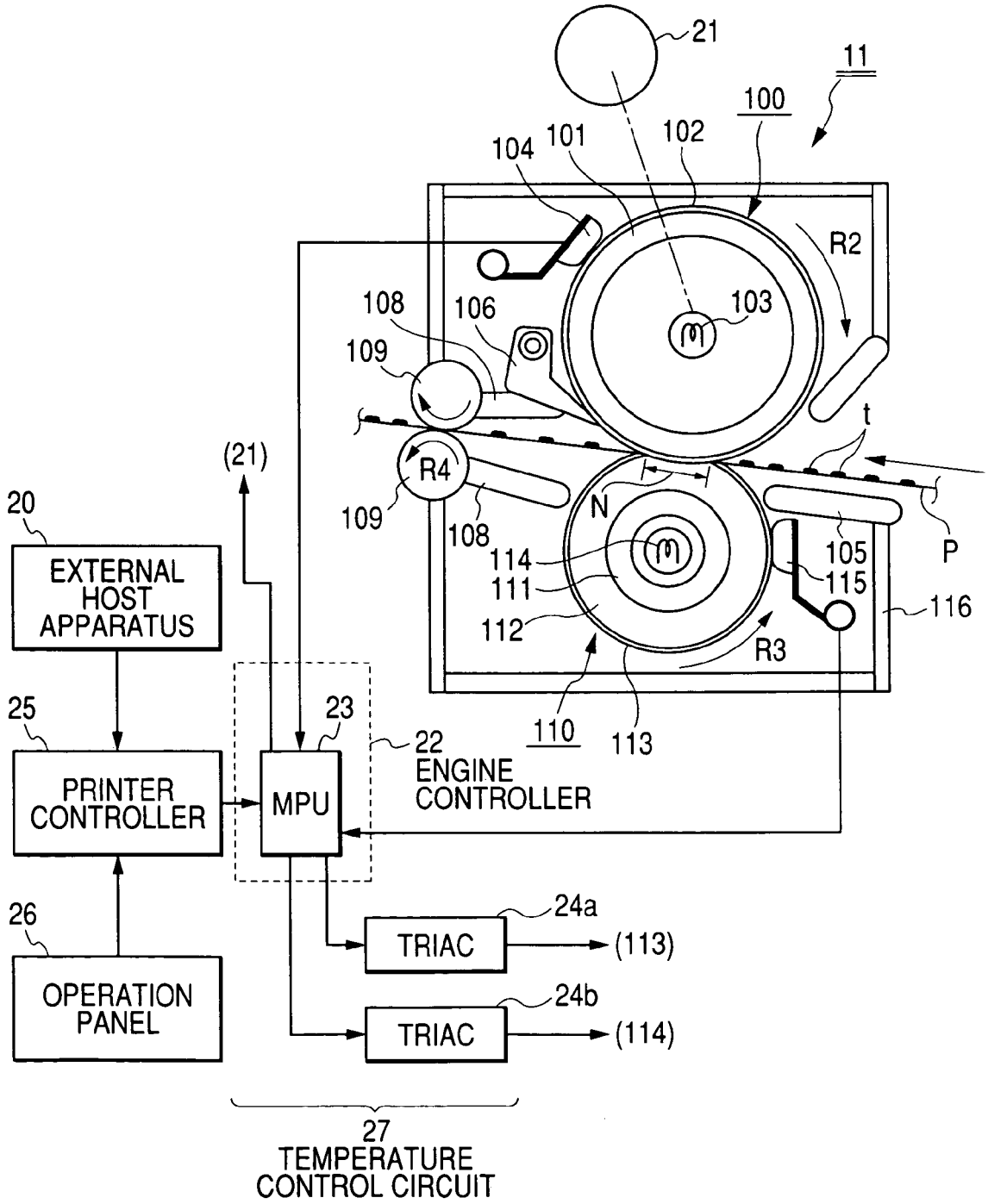
FIG. 2 is a structural model diagram of a fixing device and its surrounding portion.

FIG. 2 is a model diagram showing an enlarged view of the fixing apparatus 11. The fixing apparatus 11 of this example is of heat roller type, and a sheet of the recording material P (the widest sheet to be processed is A3 paper: 297 mm in width) is transported through the fixing apparatus 11 centered side-to-side.

Reference Numeral 100 designates a fixing roller 101 as a fixing rotation member (heat-fixing means) is provided in the fixing apparatus. The fixing roller 100 has a core 101, which is an aluminum, hollow roller with a diameter of 50 mm and a thickness of 3.0 mm and which is covered with a release layer 102 made of PFA. A heater 103 such as a halogen heater is placed as fixing roller heating means in approximately the center of the hollow of the core 101.

In the case where the printer is a high-speed or full-color laser printer, an elastic layer may be formed from silicone rubber or the like between the core 101 and the release layer 102 in order to obtain better fixing performance. The core 101 may be other metal than aluminum (iron, for example). The release layer 102 may be formed of a material other than PFA (PTFE, for example).

A pressure roller 110 as a pressure rotation member (pressurizing means). The pressure roller 110 has a core 111, which is a hollow roller formed from a 5.0-mm thick aluminum film, an elastic layer 112, which is formed from silicone rubber on the core 111, and a release layer 113, which is made of PFA and constitutes the topmost layer. The pressure roller 110 is 40 mm in diameter and 63° in product hardness (measured by Asker-C with the use of a 1 kg load). The pressure roller 110 too has a halogen lamp or the like in approximately the center of the hollow of the core as pressure roller heating means (heater 114).

The core 111 may be formed of other metal than aluminum (iron, for example). The elastic layer 112 may be formed of an elastic material other than silicone rubber as long as it is resistant to heat and is low in hardness (silicone sponge, for example). The release layer 113 may be made of other resin materials than PFA as long as the material facilitates releasing to a great degree (PTFE, for example). Electroconductive particles may be dispersed in the PFA or PTFE layer serving as the release layer 113 to give the release layer 113 an electroconductivity.

The fixing roller 100 and the pressure roller 110 are arranged in parallel to and on top of each other between two side plates one of which is on the near side of a fixing frame (fixing apparatus housing) 116 and the other of which is on the far side of 116. The rollers 100 and 110 are axially held in a manner that allows the rollers to rotate freely. Biasing means (not shown) presses the pressure roller 110 against a lower face of the fixing roller 100 at a pressuring force of 600 N while resisting the elasticity of the elastic layer 112. Formed as a result between the pressure roller 110 and the fixing roller 100 is a fixing nip portion N with a width of 7.0 mm.

Temperature detecting devices 104 and 115 (hereinafter referred to as thermistors 104 and 115) are elastically in contact with the fixing roller 100 and the pressure roller 110, respectively, in order to detect the surface temperature of the fixing roller 100 and the pressure roller 110.

A fixing apparatus entrance guide 105 is arranged in the fixing apparatus 11. The recording material P transported from the transfer unit carrying the unfixed toner image t is introduced by the entrance guide 105 into the fixing nip portion N between the fixing roller 100 and the pressure roller 110. The entrance guide 105 has a guide face formed from a resistance controlling material such as PBT ($10^8$ to $10^{10}$ Ω) or from metal such as stainless steel. The resistance controlling material is also used at a point where the entrance guide comes into contact with the fixing frame. This is because a guide face of an entrance guide formed from an insulator or the like is charged by friction with a recording material and raises problems such as scattering of toner.

A fixing roller separation claw 106 is placed in a manner that makes the claw tip lightly touch a surface of the fixing roller 100 on the recording material exit side of the fixing nip portion N.

A sheet delivery guide 108 and the sheet delivery roller 109 are placed on the recording material exit side of the fixing nip portion N.

The fixing roller 100 is driven and rotated at clockwise, in the direction of an arrow R2, at a given peripheral velocity by a drive system (not shown) that includes a DC motor 21. In conjunction with the rotation of the fixing roller 100, the pressure roller 110 and the sheet delivery roller 109 are driven and rotated in the directions of arrows R3 and R4 at a peripheral velocity substantially identical to that of the fixing roller 100.

The heaters 103 and 104 respectively placed in the hollow of the fixing roller 100 and the pressure roller 110 are 1000 W and 500 W power for an input of 100 V. Heat from the heaters is distributed symmetrically to a sheet that passes between the rollers.

1) Pre-multiple Rotation Step

A main power switch (not shown) of the printer is turned on to start a pre-multiple rotation step (warm-up operation step) of the printer by the engine controller 22. The pre-multiple rotation step is for driving a main motor (not shown) of the printer to drive and rotate the photosensitive drum 1 and activate given process equipment.

The MPU 23 serving as controlling means drives the DC motor 21 to drive and rotate the fixing roller 100 of the fixing apparatus 11. The pressure roller 110 and the fixed sheet delivery roller 109 are driven and rotated in conjunction with the rotation of the fixing roller 100.

The MPU 23 also electrifies the fixing roller heater 103 to heat the fixing roller 100 from the inside. This raises the surface temperature of the fixing roller 100. The surface temperature is detected by the thermistor 104 and information of the detected temperature is inputted to the MPU 23. The MPU 23 allows a triac 24*a* of an electrifying circuit for the fixing roller heater 103 to operate intermittently based on the detected temperature information in order to turn the fixing roller heater 103 on and off. The MPU 23 controls the fixing roller heater 103 such that the surface temperature of the fixing roller 100 reaches and retains a given standby temperature, 180° C. in this example. The triac 24*a* and a triac 24*b*, which is described later, are switching devices for opening or cutting a current flow from a commercial power source to the heater 103 (or 114).

The temperature of the pressure roller 110 is controlled in accordance with a temperature control mode appropriately selected from four temperature control modes I through IV including a mode in which the pressure roller heater 114 is not electrified at all (details thereof will be given in the following Section (3)). The pressure roller heater 114 raises the surface temperature of the pressure roller 110 to a temperature level dictated by the temperature control mode selected and maintains the temperature level.

That is, the MPU 23 electrifies the pressure roller heater 114 when the temperature control mode selected is not the one in which the heater 114 is not to be electrified, so that the interior of the pressure roller 110 is heated and the surface temperature of the roller 110 is raised. The surface temperature is detected by the thermistor 115 and information of the detected temperature is inputted to the MPU 23. The MPU 23 allows the triac 24*b* of an electrifying circuit for the pressure roller heater 114 to operate intermittently based on the detected temperature information in order to turn the pressure roller heater 114 on and off. The MPU 23 controls the pressure roller heater 114 such that the surface temperature of the pressure roller 110 reaches and retains a temperature level dictated by the temperature control mode selected.

In the above structure, the termistors 104 and 115, the MPU 23, the triacs 24*a* and 24*b* constitute a temperature control circuit 27, which is temperature adjusting means for the fixing roller 100 and the pressure roller 110.

2) Standby Step

After the pre-multiple rotation step is completed, the engine controller 22 turns the main motor off to stop rotation of the photosensitive drum 1 and keeps the printer on standby until a print start signal is inputted.

In the standby step, the MPU 23 turns the DC motor 21 off to stop rotation of the fixing roller 100, the pressure roller 110, and the fixed sheet delivery roller 109 of the fixing apparatus 11. The temperature control circuit 27 keeps the surface temperature of the fixing roller 100 and the surface temperature of the pressure roller 110 at the standby temperature and at a temperature level dictated by the temperature control mode selected, respectively.

Since the fixing roller 100 and the pressure roller 110 stops rotating as the printer is put into a standby state, heat and stress from the load could concentrate on a portion of the pressure roller 110 that is around the fixing nip portion N. To avoid this, the MPU 23 drives the DC motor 21 intermittently, for 100 msec at 30-minute intervals in this embodiment, and accordingly rotates the fixing roller 100 and the pressure roller 110 intermittently. The portion of the pressure roller 110 that is around the fixing nip portion N is thus moved to a different position. The period in which the fixing roller 100 and the pressure roller 110 are intermittently driven is set such that the pressure roller 110 does not make a full turn (the portion of the pressure roller 110 that is around the fixing nip portion before the intermittent driving should not return to the original position).

3) Pre-rotation Step

When a print start signal is inputted, the engine controller 22 drives the main motor of the printer again to re-start rotation of the photosensitive drum and to make given process equipment execute a print preparation operation.

The MPU 23 drives the DC motor 21 to rotate the fixing roller 100 of the fixing apparatus 11. The pressure roller 110 and the fixed sheet delivery roller 109 are driven and rotated in conjunction with the rotation of the fixing roller 100. The MPU 23 switches the adjustment temperature of the fixing roller 100 from the standby temperature, 180° C. in this example to a print temperature, 190° C. in this example. The surface temperature of the fixing roller 100 is raised to the print temperature and the temperature control circuit 27 works to maintain the print temperature. The MPU 23 switches the adjustment temperature of the pressure roller 110 from the adjustment temperature during a standby period to a print temperature, 140° C. in this example, and performs necessary temperature control.

4) Printing Step

After the pre-rotation step is completed (after the thermistor 104 detects that the temperature of the fixing roller 100 reaches the print temperature, 190° C.), the engine controller 22 starts a printing step.

The recording material P transported from a transfer unit T carrying the unfixed toner image t is guided by the entrance guide 105 of the fixing apparatus 11 to the fixing nip portion N where the rotating fixing roller 100 and pressure roller 110 are pressed against each other to be held and transported in the fixing nip portion N. The toner image is fixed on the surface of the recording material P through heat from the fixing roller 100 heated at the predetermined print temperature and pressure by a pressuring force of the fixing nip portion N. Exiting the fixing nip portion N, the recording material P is separated from the surface of the fixing roller 100 by the fixing roller separation claw 106 and is discharged from the fixing apparatus by the sheet delivery guide 108 and the sheet delivery roller 109.

In the printer of this embodiment, the standby temperature of the fixing roller 100 is always set to 180° C. so that an equal fast print speed is maintained in every pressure roller temperature control mode upon receiving a command to print. The print temperature of the fixing roller 100 is set to 190° C. to achieve the maximum throughput of 50 ppm when A4 paper is printed from one side to the other with the process speed set to 233.3 mm/sec and paper intervals to 70 mm.

5) Post-rotation Step

After one copy is printed (mono-print) or several copies are printed in succession (multi-print), the engine controller 22 keeps the main motor turned on for a while to keep the photosensitive drum 1 rotated and start a finishing operation of the given process equipment.

In the post-rotation step, the MPU 23 keeps the DC motor 21 turned on to keep the fixing roller 100 and the pressure roller 110 of the fixing apparatus 11 rotated. The MPU 23 switches the adjustment temperature of the fixing roller 100 from the print temperature, 190° C., to the standby temperature, 180° C. and the temperature control circuit 27 keeps the fixing roller 100 at the standby temperature. The surface temperature of the pressure roller 110 is set to the temperature level dictated by the pressure roller temperature control mode selected and the temperature level is maintained by the temperature control circuit 27.

6) Standby Step

After the predetermined post-rotation step of the printer is completed, the engine controller 22 turns the main motor off to stop rotation of the photosensitive drum 1 and holds the printer on standby until the next print start signal is inputted.

During this standby step, the MPU 23 does not drive the DC motor 21 and accordingly the fixing roller 100, the pressure roller 110, and the fixed sheet delivery roller 109 of the fixing apparatus 11 do not rotate. The temperature control circuit 27 keeps the surface temperature of the fixing roller 100 and the surface temperature of the pressure roller 110 at the standby temperature and at a temperature level dictated by the pressure roller temperature control mode selected, respectively.

In this step also, the MPU 23 drives the DC motor 21 intermittently, for 100 msec at 30-minute intervals in this embodiment, and accordingly rotates the fixing roller 100 and the pressure roller 110 intermittently. A portion of the pressure roller 110 that is around the fixing nip portion N is thus moved to a different position to avoid local concentration of heat or stress due to the load on the portion of the pressure roller 110 that is around the fixing nip portion N which otherwise takes place as the standby step is started and the fixing roller 100 and the pressure roller 110 stop rotating.

7) Each time a print start signal is inputted, Steps 3) through 6) are repeated. If a print start signal is inputted during the pre-multiple rotation step (Step 1), the standby step (Step 2) is skipped after the pre-multiple rotation step (Step 1) and the pre-rotation step (Step 3) is started, followed by the printing step (Step 4).

8) In the present invention, the term non-printing time refers to a period of time other than the printing time (including the pre-rotation and sheet feeding intervals during continuous printing) during a period from the time the main power switch of the image forming apparatus is turned on and the time the switch is turned off. Non-printing time therefore includes periods such as when the image forming apparatus is on standby (including the pre-multiple rotation and the post-rotation), the image forming apparatus is in a power saving mode, and when the image forming apparatus is in a sleep mode.

(3) Pressure Roller 110 Temperature Control Modes

In this embodiment, a temperature control mode of the pressure roller 110 during a standby period can arbitrarily be chosen (arbitrary command selection) from the four temperature control modes I, II, III and IV which are shown in Table 1 and set in the MPU 23 by an I/F command from the printer controller board 25.

TABLE 1

| Temperature control mode | I/F command | Adjustment temperature of pressure roller | Service life of pressure roller |
|---|---|---|---|
| I | 00 | 140° C. | 2000 h |
| II | 01 | 125° C. | 4000 h |
| III | 10 | 110° C. | 6500 h |
| IV | 11 | No electrification control (95° C.) | 10000 h or longer |

The temperature control mode I gives priority to fixing performance and an I/F command for the temperature control mode I is "00". When the I/F command "00" that gives priority to fixing performance is chosen, the adjustment temperature of the fixing roller 100 during a standby period is set to 180° C., the adjustment temperature of the fixing roller 100 during printing is set to 190° C., and the adjustment temperature of the pressure roller 110 during a standby period and printing is set to 140° C. so that satisfactory fixing performance can be secured for users who frequently use rough-surface paper or thick paper.

In the temperature control modes II and III, the adjustment temperatures of the pressure roller 110 during a standby period are set to 125° C. and 110° C., respectively, which are lower than the adjustment temperature in the temperature control mode I, 140° C. The I/F command is "01" for the mode II and "10" for the mode III. The adjustment temperature of the pressure roller 110 during printing is set to 140° C. in either mode. The adjustment temperature of the fixing roller 100 during a standby period is set to 180° C. in either mode. The adjustment temperature of the fixing roller 100 during printing is set to 190° C. in either mode.

The temperature control mode IV gives priority to the service life of the pressure roller, and an I/F command of the temperature control mode IV is "11". When the I/F command "11" that gives priority to the pressure roller service life is chosen, the heater 114 of the pressure roller 110 is not electrified during a standby period (pressure roller heater 114=OFF). When the pressure roller heater 114 is not electrified, the surface temperature of the pressure roller 110 is still kept at about 95° C. because of the heat transmitted from the fixing roller 100. The adjustment temperature of the pressure roller 110 during printing is set to 140° C. The adjustment temperature of the fixing roller 100 during a standby period is 180° C. The adjustment temperature of the fixing roller 100 during printing is set to 190° C.

In this embodiment, the standby temperature of the fixing roller 100 is always set to 180° C. so that an equal fast print speed is maintained in each of the pressure roller temperature control modes I through IV upon receiving a command to print.

The service life of the pressure roller 110 in this embodiment is about 2000 hours when the adjustment temperature of the pressure roller 110 during a standby period (and during printing) is set to 140° C. in the temperature control mode I. As the adjustment temperature of the pressure roller 110 during a standby period is lowered in the temperature control mode II and even lower in the mode III, the pressure roller service life is prolonged to about 4000 hours and about 6500 hours. In the temperature control mode IV where the pressure roller is not electrified, the pressure roller service life is 5 times that of the mode I, or longer. Here, the service life of the pressure roller 110 is considered to have reached its end when the elastic layer 112 of the pressure roller 110 is deformed permanently and emits abnormal noise as the pressure roller 110 rotates.

In the case where a user prints a large number of sheets of rough-surface paper and thick paper, the I/F command "00" for the temperature control mode I or "01" for the temperature control mode II can be chosen by giving priority to improved fixing performance. Then satisfactory fixing performance is always obtained irrespective of the type of the recording material P.

On the other hand, users who print plain paper most of the time may choose the I/F command "10" for the temperature control mode III or "11" for the temperature control mode IV to use the pressure roller 110 for a long period of time while achieving satisfactory fixing performance.

If the I/F command "11" for the temperature control mode IV is chosen for users who frequently print plain paper, the service life of the pressure roller 110 can be prolonged while ensuring sufficient fixing performance.

It takes progressively longer time for the surface temperature of the pressure roller 110 to reach its adjustment temperature during printing, 140° C., as the standby temperature control mode of the pressure roller 110 is changed from the mode I to the mode IV. If the throughput is the same for every mode, the pressure roller service life becomes progressively longer from the mode I to the mode IV.

The difference between the sum of periods in which the temperature is adjusted during printing time of the image forming apparatus and the sum of periods in which the temperature is adjusted when the image forming apparatus is kept on standby for 24 hours is small enough to be tolerated in practice. It is therefore effective to change the pressure roller temperature control state during a standby period in prolonging the service life of the pressure roller.

In other words, the service life of the pressure roller is shortened when the adjustment temperature of the pressure roller during a standby period is set high and the temperature adjustment takes long. Accordingly, changing the adjustment temperature of the pressure roller during a standby period in the manner described above or reducing the sum of the periods in which the pressure roller is heated to high temperature without control is effective for extending the service life of the pressure roller.

In this embodiment, four levels of control state (four temperature control modes) can be selected by way of 2-bit I/F commands sent from the printer controller board 25. The bit number may be raised to increase the number of temperature control modes, or may be reduced to two levels, for example, from the I/F command "00" to "0" and "11" to "1".

It is also possible to switch the control state from one to another with the use of identifiable information other than dedicated I/F commands, such as a firmware version of the printer controller board 25.

Another way to select a control state is switching between switches on an electric circuit or jumper wires.

The above description is directed to the case where the pressure roller temperature control condition during a standby period is made changeable. Effects of the present invention are obtained when the pressure roller temperature control condition during non-printing time (while the image forming apparatus is on standby, in a power saving mode, and in a sleep mode) is changeable. Although the adjustment temperature of the pressure roller during printing is always 140° C. in Embodiment 1, this pressure roller temperature control condition too may be changed while balancing between the fixing performance and the pressure roller service life. The same applies to the following Embodiments 2 through 4.

(Embodiment 2)

Embodiment 2 of the present invention is described. A fixing apparatus of this embodiment is structured in the same manner as shown in FIG. 2. This embodiment is an application example in which the adjustment temperature of the pressure roller 110 during a standby period is set for each temperature control mode by the input power of the pressure roller heater 114.

Figure 3:
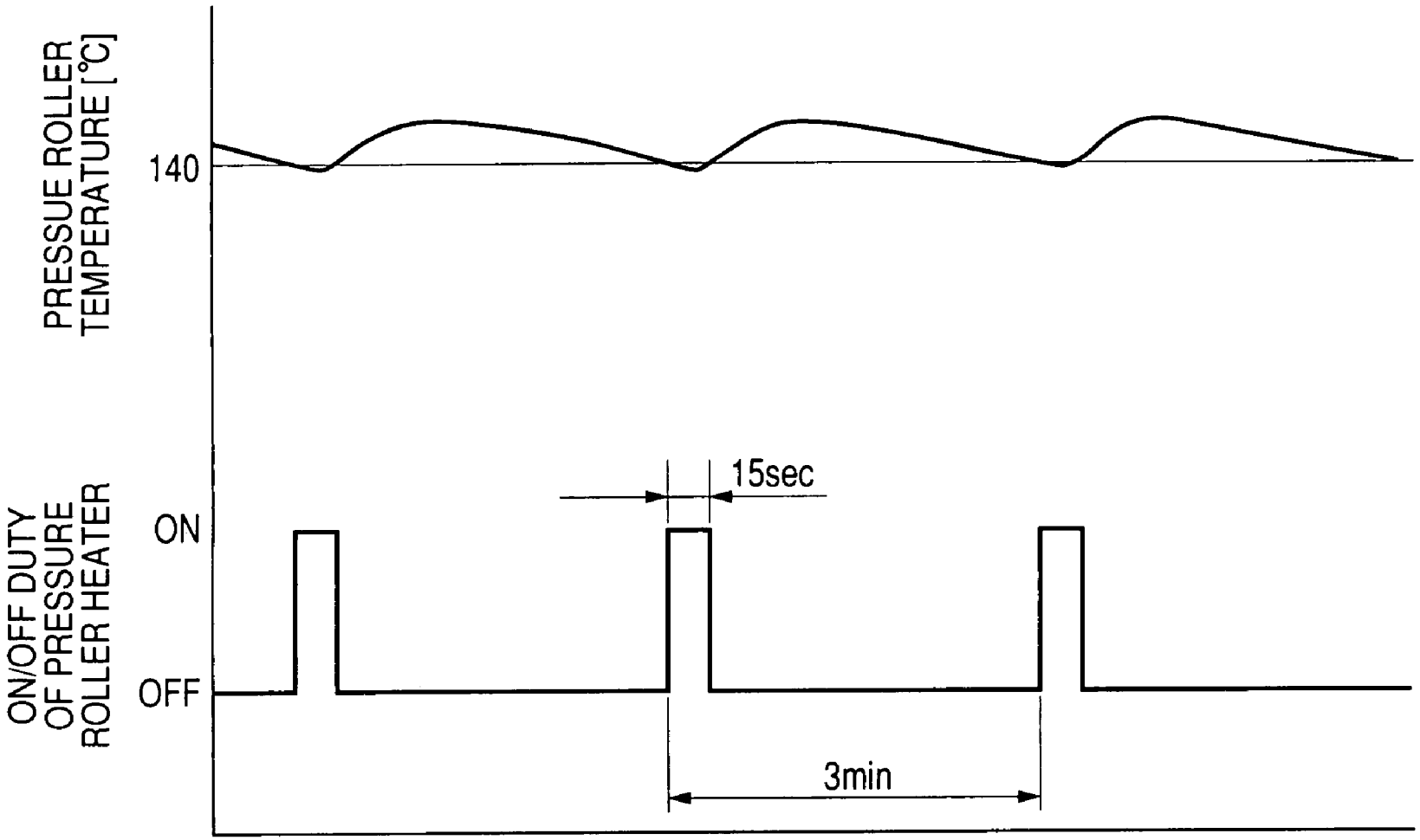
FIG. 3 is a graph showing the relation between a drive signal of a pressure roller heater and a surface temperature of a pressure roller in Embodiment 2.

To control the pressure roller with electric power, the ON duty of the pressure roller heater 114 is set as shown in FIG. 3, so that given electric power is inputted per unit time.

Although there is a slight change in the surface temperature of the pressure roller depending on the temperature of the environment or the interior temperature of the apparatus, a thermal energy received by the elastic layer 112 of the pressure roller 110 per unit time is kept constant by control.

The ON duty of the pressure roller heater in FIG. 3 is 15 seconds per 3 minutes. The adjustment temperature can be changed by changing this period.

Table 2 shows the relation between the I/F command, ON duty, and pressure roller temperature.

TABLE 2

| I/F command | ON duty of pressure roller heater per 3 min | Temperature of pressure roller | Service life of pressure roller |
|---|---|---|---|
| 00 | 15 sec | 140° C. | 2000 h |
| 01 | 10 sec | 125° C. | 4000 h |
| 10 | 5 sec | 110° C. | 6500 h |
| 11 | 0 sec | 95° C. | 10000 h or longer |

The ON duty in Table 2 is a count per 3 minutes. Alternatively, the interval may be changed while the ON time is kept constant.

(Embodiment 3)

Embodiment 3 of the present invention is described. A fixing apparatus of this embodiment is structured in the same manner as shown in FIG. 2. This embodiment shows a method in which the interval of rotation of the pressure roller 110 during a standby period is switched while the rotation time is kept constant. As described above, the pressure roller 110 during a standby period is rotated by intermittent rotation of the fixing roller 100 which accompanies intermittent driving of the DC motor 21 by the MPU 23.

The fixing roller 100 and the pressure roller 110 stop rotating as a standby period is started, and a portion of the pressure roller 110 around the fixing nip portion N is locally pressurized. If this state lasts long, the elasticity of the elastic layer 112 is degraded to turn elastic deformation into permanent deformation and raise problems such as abnormal noise. It is therefore desirable to rotate the pressure roller 110 periodically. The pressure roller 110 should be rotated at shorter intervals as the temperature is set higher.

In this embodiment, the pressure roller 110 is rotated for 100 msec at a time during a standby period, and the pressure roller rotation interval and the pressure roller adjustment temperature are switched by I/F commands as shown in Table 3.

TABLE 3

| I/F command | Interval of rotation of pressure roller | Adjustment temperature of pressure roller | Service life of pressure roller |
|---|---|---|---|
| 00 | 3 min | 140° C. | 3000 h |
| 01 | 5 min | 125° C. | 5000 h |
| 10 | 10 min | 110° C. | 8000 h |
| 11 | 30 min | No control (95° C.) | 10000 h or longer |

The pressure roller 110 in this embodiment is rotated at 3-minute intervals and thus can have a service life 1.5 times longer than in Embodiment 1 where the pressure roller 110 is rotated at 30-minute intervals.

(Embodiment 4)

Figure 4:
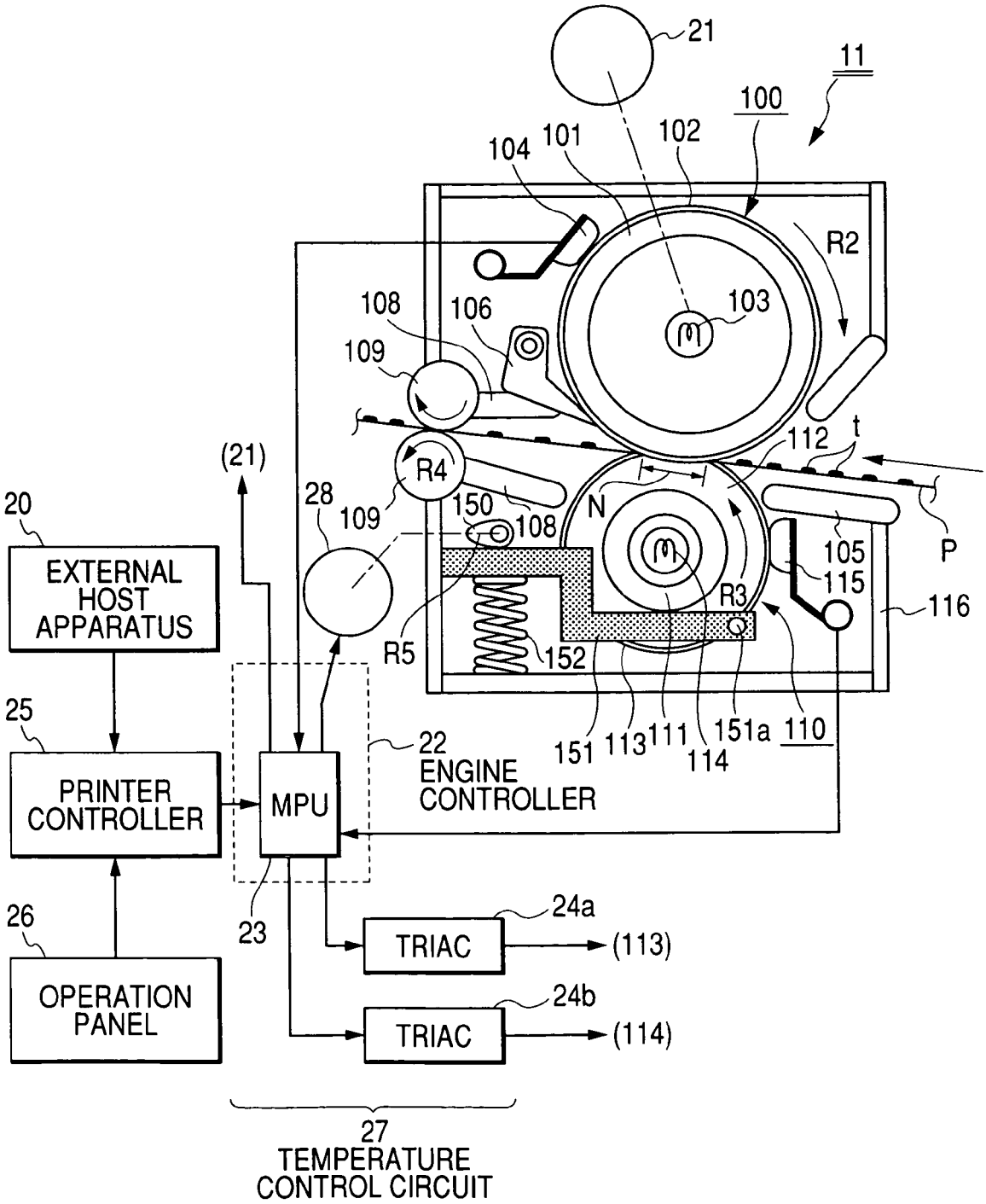
FIG. 4 is a structural model diagram of a fixing device according to Embodiment 4.

Now, a description is given on Embodiment 4 of the present invention. A fixing apparatus of this embodiment is structured as shown in FIG. 4. The fixing apparatus is equipped with pressurizing force changing means, which is capable of changing the pressurizing force of the pressure roller 110 in order to avoid wrinkling of a recording material (envelope). This embodiment shows an example of switching the drive time of the pressure roller 110 of the thus structured fixing apparatus during a standby period by I/F commands.

In FIG. 4, Reference Numeral 151 denotes a pressure plate, which can be swung up and down about a support axis 151*a* at one end. Denoted by 152 is a pressure spring for pushing up and biasing the other end of the pressure plate 151 which is opposite to the support axis 151*a*. The pressure plate 151 supports an end of the pressure roller 110 in a manner that allows the pressure roller 100 to rotate freely, and is in contact with a lower face of a movable bearing member (not shown), which can be moved in the direction of the fixing roller 100. The pressure plate 151 and the pressure spring 152 are placed on the near side and far side of the fixing roller 100, respectively, so that movable bearing members on the near side and far side of the fixing roller 100 are evenly pushed up and biased by the pressure spring 152 and the pressure plate 151. As a result, the pressure roller 110 is pressed against the lower face of the fixing roller 100 at a pressurizing force of 600 N, which is the same print setting as Embodiment 1, while resisting the elasticity of the elastic layer 112. The fixing nip portion N with a width of 7.0 mm is thus formed between the pressure roller 110 and the fixing roller 100.

Denoted by 150 is a cam serving as pressurizing force changing means. The cam 150 is repeatedly turned in the direction of an arrow R5 by approximately 90° by a turning mechanism that includes a motor 28 to be alternately switched between a first turn angle position at which the tip of the cam points leftward in the drawing and a second turn angle position at which the raised portion of the cam faces downward. The motor 28 is driven and controlled by the MPU 23. When the tip of the cam 150 points leftward at the first turn angle position, the cam 150 does not exert any action on the pressure plate 151 and the pressure roller 110 is pressed against the lower face of the fixing roller 100 by the pressure spring 152 at a pressurizing force of 600 N according to the print setting. When the cam 150 is turned and switched to the second turn angle position at which the raised portion of the cam 150 faces downward, the cam 150 depresses the pressure plate 151 and moves the plate about the support axis 151*a* while resisting against the upward biasing force of the pressure spring 152. This changes the pressurizing force with which the pressure roller 110 is pressed against the lower face of the fixing roller 100 to 100 N in this embodiment.

The rest of the fixing apparatus structure is identical to the fixing apparatus of FIG. 2 and therefore the description thereof will not be repeated here.

In this embodiment, the MPU 23 turns the cam 150 to the second turn angle position while the printer is on standby to thereby reduce the pressurizing force with which the pressure roller 110 is pressed against the fixing roller 100 from 600 N according to the print setting to 100 N. At this point, the drive torque of the fixing roller 100 and pressure roller 110 by the DC motor 21 is reduced to 1/50 of the drive torque applied when the pressurizing force is 600 N. Therefore, if the motor drive time is the same, the rotation amount is greatly increased.

Compared to the case where a temperature change of the pressure roller 110 causes a change in drive torque and the temperature is adjusted to 140° C. (the temperature control mode I), the drive torque is about 1.5 times larger in the mode where the pressure roller heater is not electrified (the temperature control mode IV).

Therefore, the drive time of the motor 21 in this embodiment is changed as shown in Table 4 in accordance with whether the pressure roller during a standby period is electrified or not and the magnitude of the pressurizing force.

TABLE 4

| I/F command | Adjustment temperature of pressure roller | Pressurizing force | Drive torque | Drive time |
|---|---|---|---|---|
| 00 | 140° C. | 600 N | 2.5 Ncm | 100 msec |
| 01 | No electrification control | 600 N | 3.7 Ncm | 150 msec |
| 10 | 140° C. | 100 N | 0.05 Ncm | 20 msec |
| 11 | No electrification control | 100 N | 0.08 Ncm | 30 msec |

The present invention makes it possible to switch between a mode in which the pressure roller is electrified and a mode in which the pressure roller is not electrified, whereby optimal fixing performance and pressure roller service life conditions can be satisfied for each pressurizing state also when the fixing apparatus has the pressurizing force changing means 150 as in this embodiment.

What is claimed is:

1. An image forming apparatus comprising:

an image formation unit for forming and bearing a toner image on a recording material;

a heat-fixing rotation member;

a first heater for heating said heat-fixing rotation member;

a pressure rotation member with an elastic layer;

a second heater for heating said pressure rotation member; and a controller for controlling power supplied to said first and said second heaters, wherein said apparatus has a plurality of selectable modes including a first and a second modes for at least a time period when the image forming apparatus is in a standby state, and wherein the first and the second modes correspond to substantially a same target temperature for the heat-fixing rotation member, and correspond to different target temperatures for the pressure rotation member.

2. An image forming apparatus according to claim 1 further comprising:

a first temperature detecting element for detecting a temperature of the heat-fixing rotation member and a second temperature detecting element for detecting a temperature of the pressure rotation member.

3. An image forming apparatus according to claim 1, wherein the plurality of selectable modes includes a mode in which no power is supplied to the second heater for at least the time period when the image forming apparatus is in a standby state.

4. An image forming apparatus according to claim 3 further comprising:

a first temperature detecting element for detecting a temperature of the heat-fixing rotation member and a second temperature detecting element for detecting a temperature of the pressure rotation member.

5. An image forming apparatus according to claim 1, wherein said apparatus comprises a printer controller board for generating dot information on the basis of information from an external host device, and one of the plurality of selectable modes is selected in accordance with a command output from said printer controller board.

6. An image forming apparatus according to claim 2, wherein said apparatus comprises a printer controller board for generating dot information on the basis of information from an external host device, and one of the plurality of selectable modes is selected in accordance with a command output from said printer controller board.

7. An image forming apparatus according to claim 3, wherein said apparatus comprises a printer controller board for generating dot information on the basis of information from an external host device, and one of the plurality of selectable modes is selected in accordance with a command output from said printer controller board.

8. An image forming apparatus according to claim 4, wherein said apparatus comprises a printer controller board for generating dot information on the basis of information from an external host device, and one of the plurality of selectable modes is selected in accordance with a command output from said printer controller board.

9. An image forming apparatus comprising:

an image formation unit for forming and bearing a toner image on a recording material;

a heat-fixing rotation member;

a first heater for heating said heat-fixing rotation member;

a pressure rotation member with an elastic layer;

a second heater for heating said pressure rotation member; and a controller for controlling power supplied to said first and said second heaters, wherein said apparatus has a plurality of selectable modes including first and second modes for at least a time period when the image forming apparatus is in a power-saving state, and wherein the first and the second modes correspond to substantially a same target temperature for the heat-fixing rotation member and to different target temperatures for the pressure rotation member.

10. An image forming apparatus according to claim 9 further comprising:

a first temperature detecting element for detecting a temperature of the heat-fixing rotation member and a second temperature detecting element for detecting a temperature of the pressure rotation member.

11. An image forming apparatus according to claim 9, wherein the plurality of selectable modes includes a mode in which no power is supplied to the second heater for at least the predetermined period during the non-printing time is a time period when the image forming apparatus is in a power-saving state.

12. An image forming apparatus according to claim 11 further comprising:

a first temperature detecting element for detecting a temperature of the heat-fixing rotation member and a second temperature detecting element for detecting a temperature of the pressure rotation member.

13. An image forming apparatus according to claim 9, wherein said apparatus comprises a printer controller board for generating dot information on the basis of information from an external host device, and one of the plurality of selectable modes is selected in accordance with a command output from said printer controller board.

14. An image forming apparatus according to claim 10, wherein said apparatus comprises a printer controller board for generating dot information on the basis of information from an external host device, and one of the plurality of selectable modes is selected in accordance with a command output from said printer controller board.

15. An image forming apparatus according to claim 11, wherein said apparatus comprises a printer controller board for generating dot information on the basis of information from an external host device, and one of the plurality of selectable modes is selected in accordance with a command output from said printer controller board.

16. An image forming apparatus according to claim 12, wherein said apparatus comprises a printer controller board for generating dot information on the basis of information from an external host device, and one of the plurality of selectable modes is selected in accordance with a command output from said printer controller board.

17. An image forming apparatus comprising:

an image formation unit for forming and bearing a toner image on a recording material;

a heat-fixing rotation member;

a first heater for heating said heat-fixing rotation member;

a pressure rotation member with an elastic layer;

a second heater for heating said pressure rotation member; and a controller for controlling power supplied to said first and said second heaters, wherein said apparatus has a plurality of selectable modes including a first and a second modes for at least a predetermined period during non-printing time, wherein the first and the second modes correspond to substantially a same target temperature for the heat-fixing rotation member, and correspond to different target temperatures for the pressure rotation member, and wherein said apparatus comprises a printer controller board for generating dot information on the basis of information from an external host device, and one of the plurality of selectable modes is selected in accordance with a command output from said printer controller board.

18. An image forming apparatus according to claim 17 further comprising:

a first temperature detecting element for detecting a temperature of the heat-fixing rotation member and a second temperature detecting element for detecting a temperature of the pressure rotation member.

19. An image forming apparatus according to claim 17, wherein the plurality of selectable modes includes a mode in which no power is supplied to the second heater for at least the predetermined period during non-printing time.

20. An image forming apparatus according to claim 19 further comprising:

a first temperature detecting element for detecting a temperature of the heat-fixing rotation member and a second temperature detecting element for detecting a temperature of the pressure rotation member.

* * * * *

UNITED STATES PATENT AND TRADEMARK OFFICE

CERTIFICATE OF CORRECTION

PATENT NO. : 7,203,440 B2
APPLICATION NO. : 10/822721
DATED : April 10, 2007
INVENTOR(S) : Hiroaki Sakai et al.

It is certified that error appears in the above-identified patent and that said Letters Patent is hereby corrected as shown below:

ON THE TITLE PAGE:
At Item (56), References Cited, Foreign Patent Documents,
"JP 2000075726 A * 3/2000" should read --JP 2000-075726 A 3/2000--.

At Item (75), Inventor, "Tomoyuki Makihira, Shizuoka (JP)" should read
--Tomoyuki Makihira, Kanagawa (JP)--.

COLUMN 1:
Line 18, "bore" should read --borne--.

COLUMN 2:
Line 4, "above-described conflicting the above-described" should read
--the above-described--.

COLUMN 3:
Line 2, "by the," should read --by the--.

COLUMN 4:
Line 26, "as an exposure device." should read --is an exposure device.--.

COLUMN 5:
Line 57, "as a pressure" should read --is a pressure--.

COLUMN 14:
Line 61, "modes" should read --mode--.

UNITED STATES PATENT AND TRADEMARK OFFICE

CERTIFICATE OF CORRECTION

PATENT NO. : 7,203,440 B2
APPLICATION NO. : 10/822721
DATED : April 10, 2007
INVENTOR(S) : Hiroaki Sakai et al.

It is certified that error appears in the above-identified patent and that said Letters Patent is hereby corrected as shown below:

COLUMN 16:
Line 4, "time is a" should read --time, a--.
Line 48, "modes" should read --mode--.

Signed and Sealed this

Fourth Day of March, 2008

JON W. DUDAS
*Director of the United States Patent and Trademark Office*